US005549144A

United States Patent [19]

Dworak et al.

[11] Patent Number: 5,549,144

[45] Date of Patent: Aug. 27, 1996

[54] COMPRESSION FILLER FOR AERATEABLE POWDERS

[75] Inventors: Adam J. Dworak, Park Ridge; Donn A. Hartman, Gurnee, both of Ill.

[73] Assignee: Cloud Corporation, Des Plaines, Ill.

[21] Appl. No.: 385,048

[22] Filed: Feb. 7, 1995

[51] Int. Cl.[6] ..... B65B 1/00

[52] U.S. Cl. ..... 141/146; 141/65; 141/71; 141/12; 141/10; 141/313

[58] Field of Search ..... 141/1, 8, 10, 12, 141/65, 67, 71, 81, 146, 147, 313, 314, 317

[56] References Cited

U.S. PATENT DOCUMENTS

| | | | |
|---|---|---|---|
| 2,626,738 | 1/1953 | Nordquist | 141/146 X |
| 3,597,898 | 8/1971 | Cloud | 53/183 |
| 3,656,518 | 4/1972 | Aronson | 141/1 |
| 3,731,715 | 5/1973 | Gageant et al. | 141/146 X |
| 4,838,326 | 6/1989 | Colacci et al. | 141/147 |
| 5,320,146 | 6/1994 | Stevie | 141/1 |

*Primary Examiner*—J. Casimer Jacyna
*Attorney, Agent, or Firm*—Dorn, McEachran, Jambor & Keating

[57] ABSTRACT

A filling head for a pouch packaging machine or the like has a plurality of rotating chambers for receiving measured amounts of an aerateable powder. Pistons aligned with the chambers can be inserted into the chambers to compress the powder and remove entrained air. The pistons are made of porous metal and communicate with a vacuum source for removing air from the chambers. The chambers can be opened after the compression stage to dispense the compacted pellet of product to an open pouch below.

11 Claims, 4 Drawing Sheets

COMPRESSION FILLER FOR AERATEABLE POWDERS

BACKGROUND OF THE INVENTION

This invention relates to a filling head for a high speed pouch packaging machine or the like. Pouches are used for a variety of dry or liquid products such as sugar, sweeteners, salt, creamers, drink mixes, soup mixes and the like. Examples of basic pouch forming and filling machines are shown in U.S. Pat. Nos. 3,344,576, 3,453,799 and 3,667,188, the disclosures of which are incorporated herein by reference. These patents show how a continuous web of pouch material is folded, sealed on two sides, filled through the open top, sealed on top and then severed into individual, filled pouches. The severed pouches are fed to a stacker or cartoner.

Most powdered products have predictable flow characteristics such as a reasonably constant density and a consistent angle of repose. Such powders can be handled by traditional methods such as hoppers, drop tubes, belt feeders, metering blocks and the like because gravity has a known, uniform effect on the flow of these products. However, not all products are amenable to traditional handling methods. Some powders can, when agitated, readily aerate and behave more like a liquid than a powder. The most commonly found example is corn starch.

This problem has many unacceptable side effects in the packaging industry, especially for flexible pouch packaging. For example, an aerated product will occasionally flow uncontrollably through any opening, including such critical openings as the base of a funnel or gate with which it is desired to meter the product. Once in the pouch the aerated product can again behave like a liquid. For instance, as the filled pouch is drawn off the filler wheel on its way to the top sealer, tension is pulled on the web causing the pockets to collapse to the volume of the product and force the air out. Normally this is not a problem but with an aerated product, i.e., one that acts like a liquid, the product can very easily be forced out the top of the pouch along with the escaping air.

SUMMARY OF THE INVENTION

The filler of the present invention accepts powders in their aerated state and in either continuous motion or intermittent packaging, volumetrically measures, compresses and removes the air from the powder and places a pellet of product in a package. As used herein the term pellet refers to the measured amount of product in its non-aerated state after compacting. The filler is capable of being mounted over standard, existing web handling configurations.

The filler of the present invention comprises a cup plate mounted horizontally over the vacuum transfer wheel that holds the side-sealed pouches open for filling. The cup plate rotates with the transfer wheel and has a plurality of chambers formed near its circumference. These chambers extend fully through the cup plate and are disposed on the plate such that they are centered over the pouch stations of the filler wheel below.

A stationary plate sits between the cup plate and the filler wheel, in sealing relation with the underside of the cup plate. The stationary plate closes the bottom openings or ports of the chambers except at a slot in the stationary plate where product can fall through the stationary plate to the underlying pouches.

Mounted above the cup plate are pistons that match the placement, size and profile of the chambers in the cup plate. These pistons move with the cup plate. They plunge linearly downwardly into the chambers to compress the aerated product after it has been introduced into the chambers. The face of the piston is porous metal, which has a physical influence on the product but will allow air to pass through. Behind the porous face is a chamber where vacuum is applied throughout the compression stage. As the piston compresses the product, the air that is forced out of the product is drawn through the porous metal face of the piston and into the vacuum chamber.

With the piston still in contact with the product and the vacuum still engaged to hold the pellet of product on the piston face, the chamber moves onto the slot in the stationary plate. The piston then continues downwardly through the cup plate and stationary plate to carry the pellet into the open pouch below. Then the vacuum is removed and a short low pressure blast of air is applied, releasing the pellet in its pouch. The piston is retracted and returned to its original position. A short blast of air may be used to clear the face of the piston.

BRIEF DESCRIPTION OF THE DRAWINGS

FIG. 3 is an enlarged, plan view of the cup plate showing the detail of a chamber superimposed on a pouch opening.

DETAILED DESCRIPTION OF THE INVENTION

Figure 1:
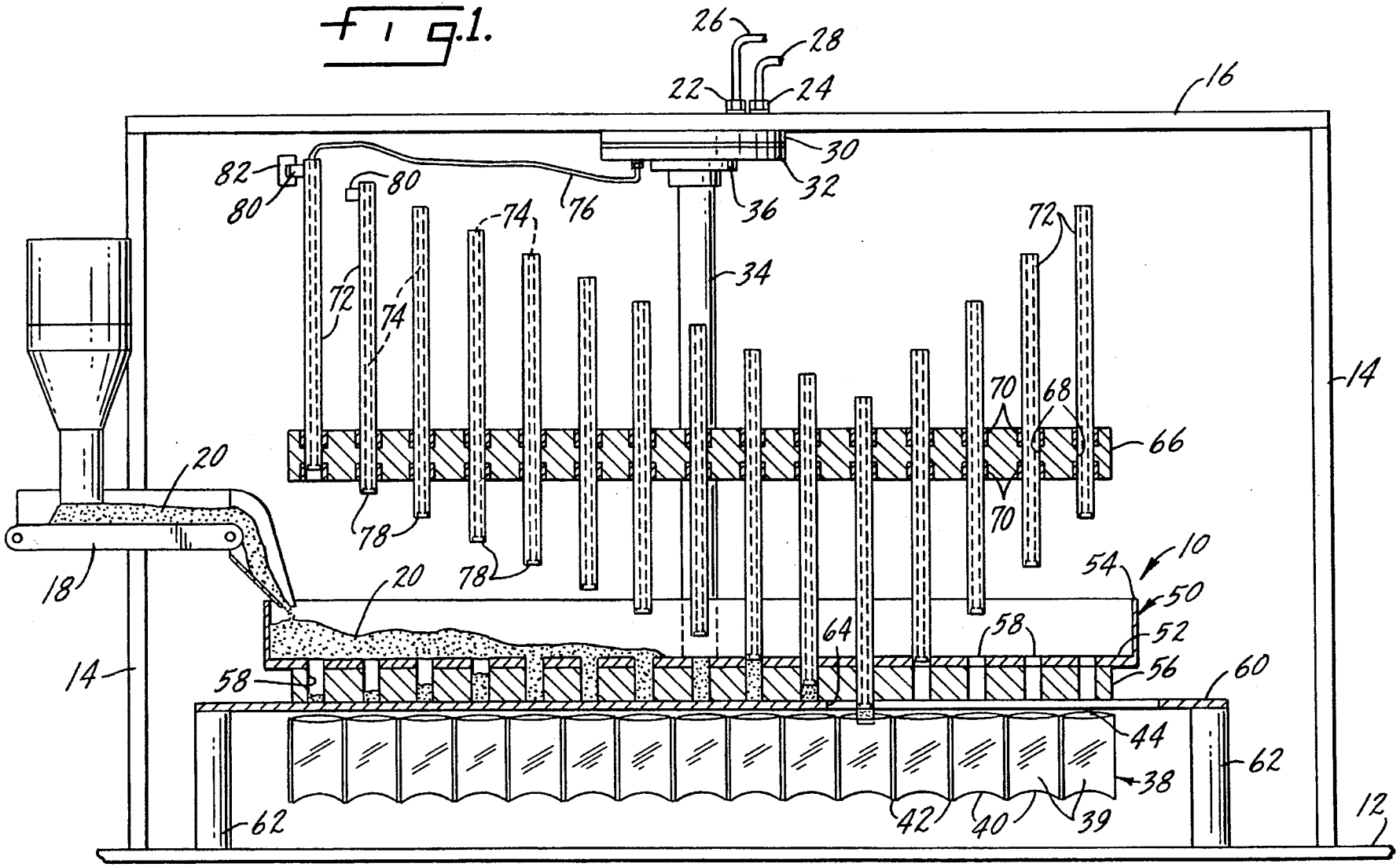
FIG. 1 is a side elevation view of the compression filler with the stationary plate slot rotated from its actual position to illustrate the plunge through stage of operation.
Figure 2:
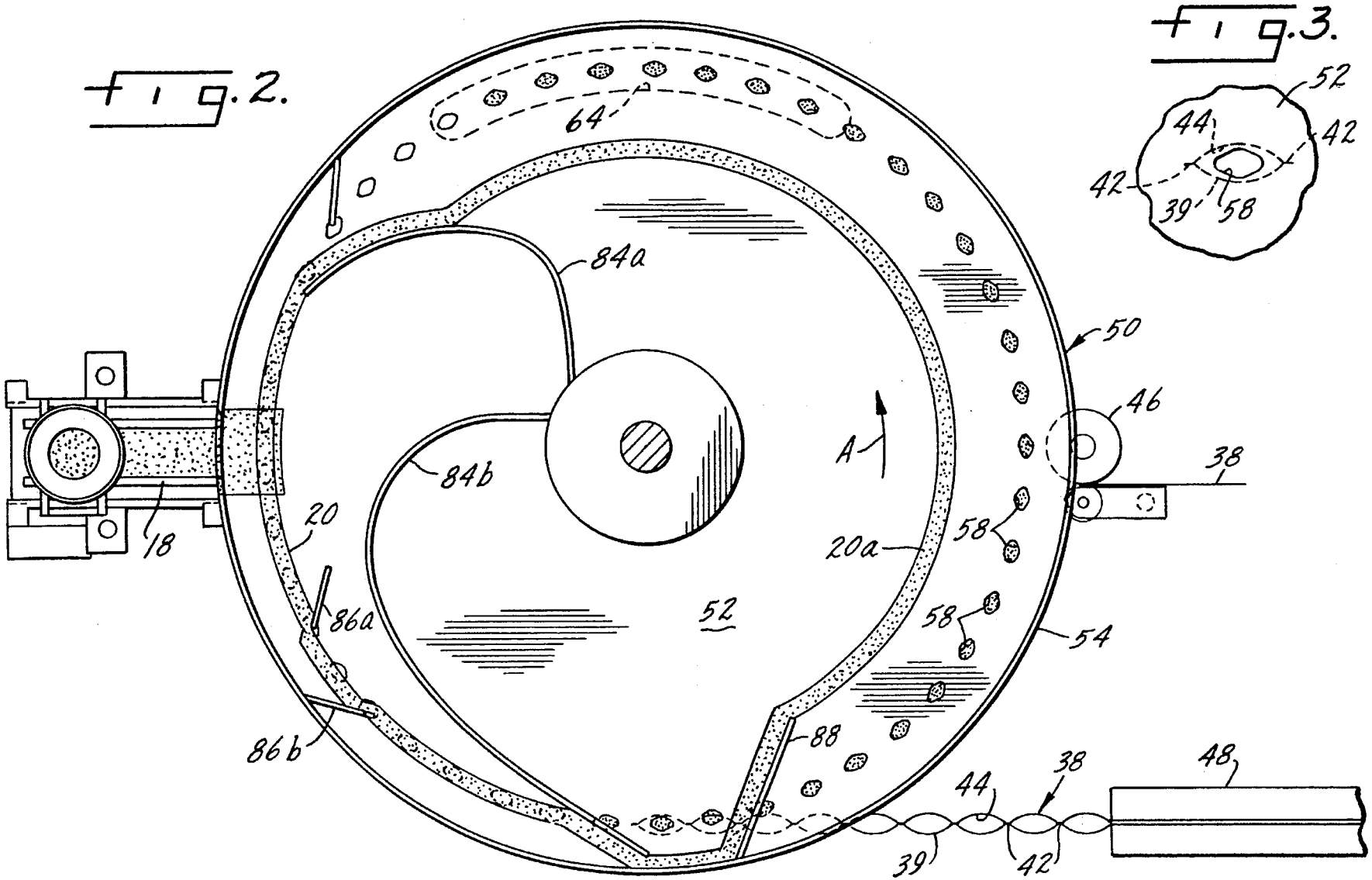
FIG. 2 is plan view of the cup plate.

FIGS. 1 and 2 illustrate a first embodiment of the compression filler 10 of the present invention. The filler is mounted on a packaging machine including a bed 12 which supports a superstructure including pillars 14 and a beam 16. One of the pillars mounts a product feed belt 18 which supplies an aerateable powder 20 to the compression filler. The beam 16 has connections or fittings 22, 24 for vacuum and air supply lines 26, 28. These fittings communicate with a stationary valve plate 30 fixed to the underside of the beam 16. The valve plate 30 interfaces with a rotating manifold plate 32. The manifold plate is carried on a rotating drive shaft extension 34, one end of which is mounted in a bearing 36 attached to the beam 16. The other end of the drive shaft extension is connected to the drive shaft (not shown) of a standard filling wheel. The filling wheel can be of the type shown in Cloud, U.S. Pat. No. 3,597,898, the disclosure of which is incorporated herein by reference. The U.S. Pat. No. 3,597,898 patent illustrates a standard rotating table with drop tubes for use with non-aerateable powders. The compression filler 10 of FIGS. 1 and 2 is intended to substitute for the standard filling table when aerateable powders are being handled.

The standard filling wheel is represented in FIG. 1 by a continuous web 38 of pouches. The wheel includes a drum attached to the usual vertical drive shaft for rotation therewith in a horizontal plane. This drive shaft connects to the drive shaft extension 34 for driving the compression filler 10. The outer surface of the filling wheel drum has a plurality of depressions which define pouch stations for receiving the continuous web 38 of pouches. Each station receives a single pouch 39 having a bottom fold 40, two vertical side seals 42 and an open top 44. A vacuum system described in the U.S. Pat. No. 3,597,898 holds the pouches in their stations and a tucker roller 46 assists in opening each pouch as it arrives at the filling wheel. After the pouches are filled the web 38 advances to a top sealer 48 (FIG. 2) where the tops of the pouches are closed and sealed.

Returning now to the compression filler 10 of the present invention, a base member in the form of a circular cup plate 50 is mounted for rotation on the drive shaft of the filling wheel drum. Rotation is in the direction of arrow A. The cup plate comprises a horizontal disc portion 52, a cylindrical rim 54 at the periphery of the disc, and a shoe 56 attached or integrally formed to the under side of the disc. The shoe has a somewhat smaller diameter than the disc.

A plurality of chambers 58 are formed in the disc 52 and shoe 56. The chambers are aligned openings through the disc and shoe, defining first and second ports where the openings terminate at the surfaces of the disc and shoe. The number and spacing of the chambers corresponds to that of the pouch station centers on the filling wheel. Furthermore, the chambers are arrayed on the disc at a diameter that places them above the pouch openings when a web is on the filling wheel. Thus, one chamber will be associated with each pouch station, with the chamber vertically aligned above the location of a pouch opening at that station.

FIG. 3 illustrates the preferred shape of the chamber superimposed on the top view of an open pouch. This shape may be described as an oval with slightly bulging sides. The bulging oval shape is preferred because it somewhat approximates the shape of the available opening in the pouch. This allows the height of a product pellet to be minimized, thereby reducing the required thickness of the shoe. A cylindrical cross-sectional shape also is satisfactory. It has the advantage of ease of machining the components which form the pellet. Minimal shoe thickness for a given product pellet weight is desirable because it reduces the stroke length, and therefore the cycle time, of a piston compression/discharge and return stroke, as will be described below.

The shoe 56 rides on top of a pellet support means in the form of a stationary plate 60. The stationary plate is preferably circular and of a diameter somewhat greater than the cup plate 50. The stationary plate 60 is disposed between the filling wheel and the shoe 56, supported from the bed 12 by legs 62. The stationary plate engages the bottom of the shoe in sealing relation, such that the plate closes the chamber ports defined at the bottom surface of the shoe. This closure of the bottoms of the chambers occurs everywhere except at an arcuate slot 64 in the stationary plate 60. As can be seen in FIG. 2, the slot is aligned with the chambers and, accordingly, the slot is aligned with the pouch openings when they are present on the filling wheel. The slot 64 defines a drop zone where pellets of product are transferred from the chambers to their destinations, namely, the awaiting pouches below.

The drive shaft extension 34 carries a piston support ring 66 intermediate the cup plate 50 and the manifold plate 30. The ring 66 rotates with the shaft extension and has a plurality of cylinders 68 therein. The cylinders are lined with bushings 70 which permit linear motion of a piston rod 72 disposed in each cylinder. The cylinders are arranged in a circle matching that of the chambers 58 so the piston rods 72 are located directly above the chambers. An axial passage 74 extends through each piston rod. The upper end of each passage 74 is in communication with the manifold plate 32 through a flexible tube, one of which is shown at 76. The lower end of each passage is closed by a piston 78 attached to the piston rod. The piston is made of porous metal to allow passage of air into and out of the passage but it will not permit passage of the powdered product. The piston has the same size and shape as the chamber, with just enough clearance to allow the piston to slide in and out of the chamber.

The upper end of each piston rod mounts a cam follower 80 (FIG. 1). Every piston rod has a cam follower 80 but only two of them are shown in the drawings. The cam followers engage the slot of a cam, a portion of which is shown at 82 in FIG. 1. It will be understood that the cam 82 is a ring fixedly mounted to the superstructure. The cam is arranged to cause a reciprocating up and down motion of the piston rods 72 as the support ring 66 rotates with the shaft extension.

The compression filler construction is completed by a series of stationary plows and gates for directing the product into the chambers. Spiral plows 84*a*, 84*b* (FIG. 2) define the initial input area of the cup plate where the product feed belt 18 floods the cup with an aerateable powder 20. Plows 86*a*, 86*b* push the product back and forth over the path of the chambers 58 to assure uniform and thorough filling. In this area of the cup plate the stationary plate 60 closes the bottoms of the chambers. The final wiper 88 pushes the product one last time across the path of the chambers, inwardly on the cup plate into a recirculating path 20*a*, leaving the chambers 58 full and uniform in volume.

The filled chambers are carried toward the slot 64 while the cam 82 causes the piston rods 72 to move downwardly toward the chambers. Once a chamber passes the final wiper 88, the filling stage of the cup plate ends and the compression stage begins. Here a piston rod descends into the chamber. At or shortly before engagement of the piston with the product in the chamber, the valve plate applies a vacuum to the passage 74. As the piston compresses the product, air trapped in the product is drawn through the porous metal face of the piston into the passage 74. The depth of the compression stroke is controllable by means of the cam and could be altered to suit a particular product. Most products compress to between 40%–60% of their original state.

The compression stage is completed while the chambers are still closed by the stationary plate 60. Then the chambers move onto the slot 64. At this time the piston is still in contact with the compressed pellet of product and the vacuum is still engaged. The piston continues to move downwardly, pushing the pellet through the slot 64 of the stationary plate and into the pouch below. Then the vacuum is relieved and a short low pressure blast of air applied, releasing that pellet of product. The piston is retracted and returned to its starting position. During the retracting a short blast of pressurized air back through the passage 74 will clear the face of the piston. This air blast is provided through the air line 28, fitting 24, valve plate 30 and manifold plate 32.

Figure 5:
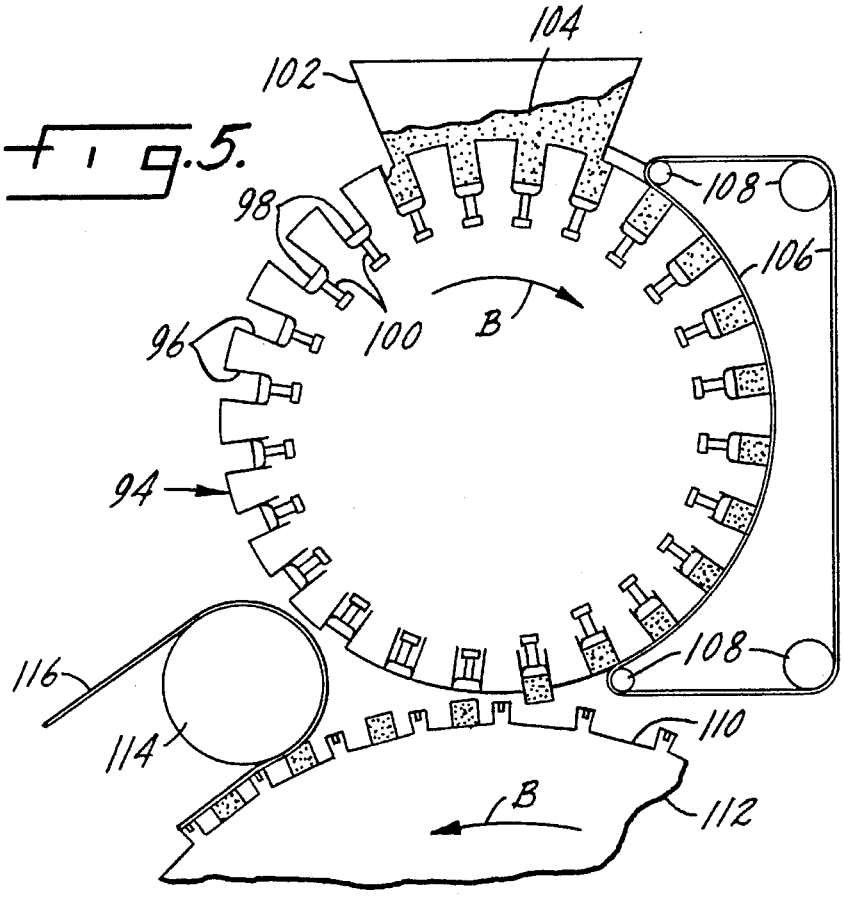
FIG. 5 is a side elevation view of an alternate embodiment of the invention.
Figure 6:
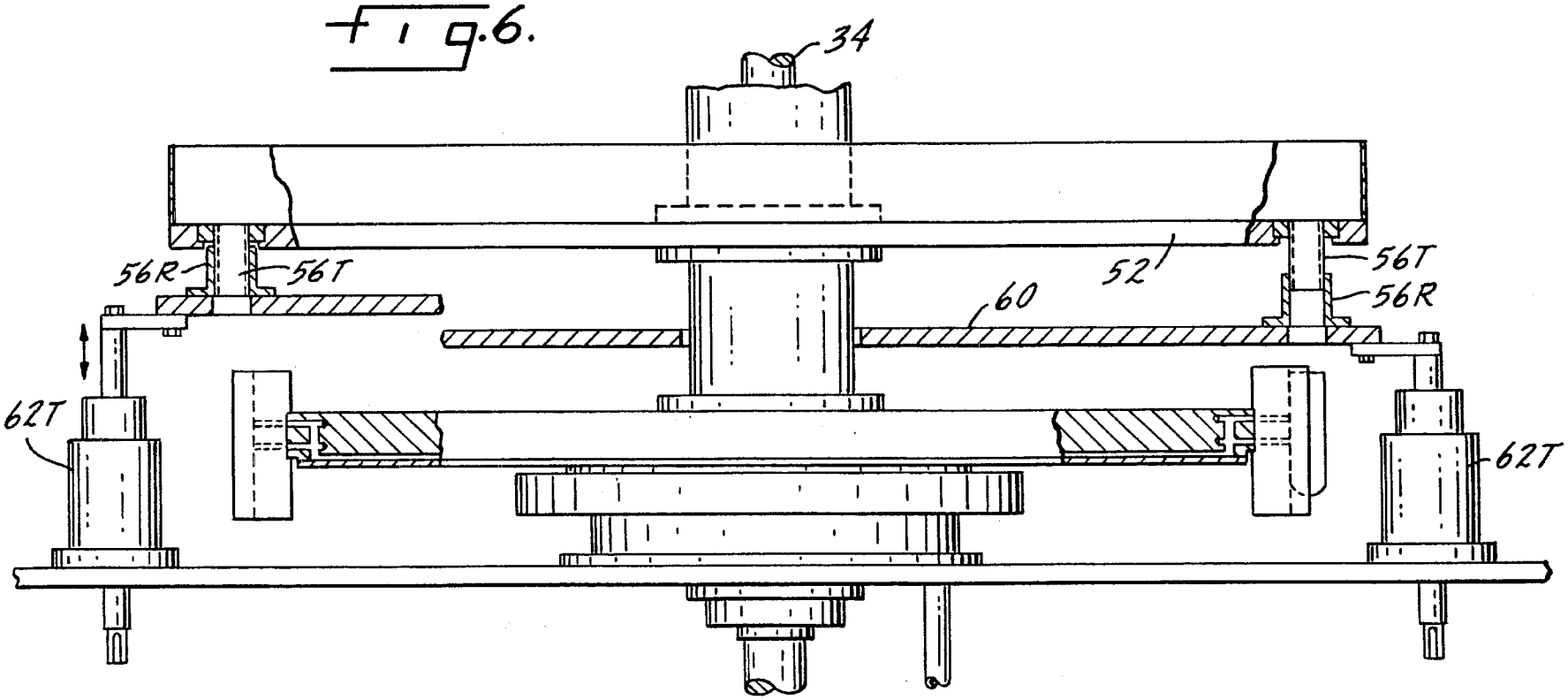
FIG. 6 is a side elevation of a modified form of the compression filler of the present invention.

The valve plate and manifold plate have appropriate passages and seals that apply the vacuum or air pressure sources to the piston rod passages at the appropriate times. Plates of this general character are shown in FIGS. 5 and 6 of the U.S. Pat. No. 3,597,898.

Weight changes for the product pellet can be achieved in several ways. For example, the pistons could partially plunge the chamber and retract, allowing another flood/plow stage to refill the evacuated portion of the chamber before the final compress and plunge-through stage. Another possible technique would be to leave a uniform depth of product over the tops of the chambers during the final plowing. As this product is compressed it would be included in the chamber. Or the chambers could be made deeper by adding an additional plate underneath the shoe 56 or by going to a thicker shoe.

Figure 4:
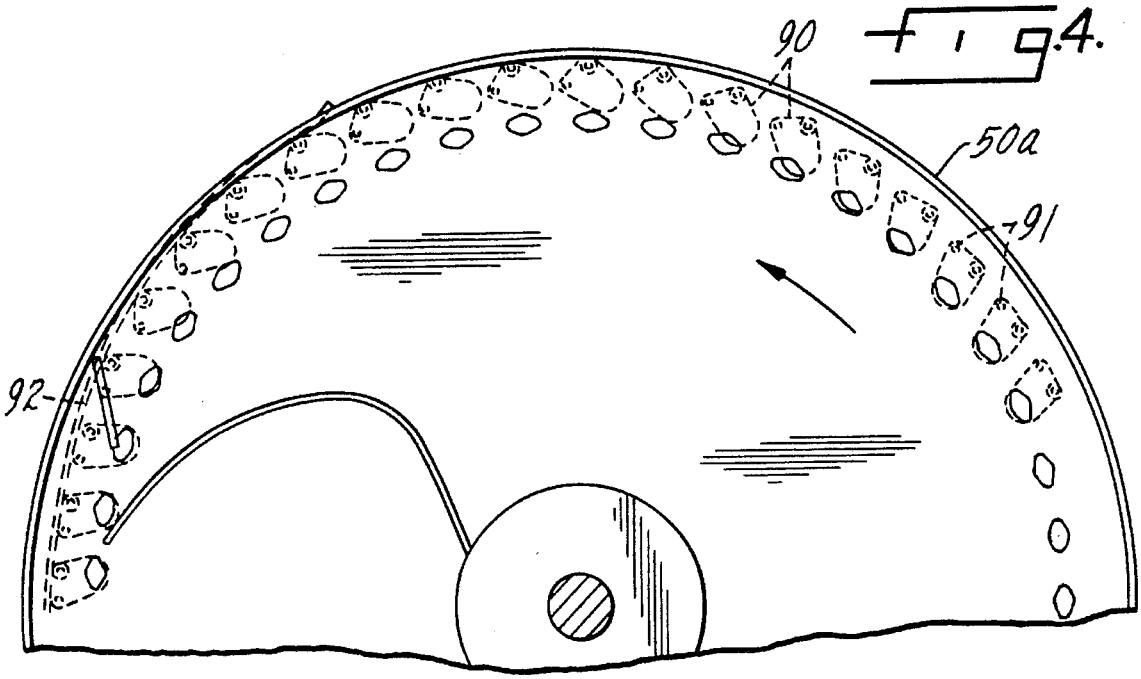
FIG. 4 is a plan view of an alternate embodiment of a cup plate having a gated bottom.

An alternate embodiment of the invention is shown in FIG. 4. This version has an alternate pellet support means. Here the chambers in cup plate 50*a* are opened and closed by individual gates 90 controlled by a stationary cam 92. The gates are hinged at 91 to the underside of the shoe and accordingly the gates rotate with the cup plate. If gates are used the stationary plate could be deleted. During the fill/plow and compression stages the gates are closed to support the product in the chambers. The cam 92 opens the gates after the compression stage to allow the piston to plunge through the cup plate and place the pellets in the pouches. After the pistons are retracted the gates are reclosed to prepare for the next cycle.

FIG. 6 is a modified form of the compression filler of the present invention. It provides for volume control through adjustment of the spacing between plate 60 and disc 52. In this embodiment plate 60 is adjustable toward and away from disc 52. Shoe 56 is eliminated.

Chambers 58 defining the pellet cross-sectional shape are formed by a plurality of tubes 56T depending from the bottom of disc 52. The upper surface of plate 60 carries a matching plurality of annular receptacles 56R into which open lower ends of tubes 56T extend in a telescoping manner. The tube ends and the upper open ends of the receptacles overlap. Adjustment of the plate 60 toward the disc 52 causes the tubes to enter further into the receptacles and thereby reduce the defined volume. Adjustment of the plate 60 away from disc 52 causes the tubes 56T to extend out of the receptacles 56R a greater amount, thereby, increasing the defined volume.

Adjustment mechanism 62T is provided which permits raising or lowering of plate 60 as desired.

The same principals of the embodiment of FIGS. 1 and 2 can apply to other forms of packing machinery, either of the constant motion or intermittent motion type. For example, FIG. 5 illustrates a compression filler for a horizontal drum machine. In this case instead of a cup plate the base member comprises a cup drum 94 having a plurality of chambers 96. Each chamber has a port opening to the drum surface and another port closed by a piston 98. The pistons are actuated by hollow piston rods 100 which are connected to vacuum and air sources as in the previous embodiment. The axis of cup drum 94 is mounted horizontally. A product reservoir 102 feeds aerateable product 104 onto the apex of the cup drum surface to fill the passing chambers. Once the chambers are filled the surface of the drum is swept clean, which as can be seen in FIG. 5, occurs just a few degrees past the apex of the drum. Then a pellet support means in the form of a flat, revolving retaining belt 106 engages the drum surface to close the chamber openings and contain the product in the chambers while it is compressed by the pistons. The belt revolves around rollers 108 and rides against the drum for the duration of the compression stage. The pistons move outwardly in the chambers, compressing the product against the belt 106. Vacuum again draws air from the product through the hollow passages in the piston rods 100. As in the prior embodiment, each piston rod 100 includes a piston 78 of porous metal at its end which contacts the product.

At the end of the compression stage, the retaining belt is disengaged and the pellet of product is held in the chamber by vacuum. The piston continues its stroke toward and through the surface of the cup drum, carrying the pellet of product into a pocket 110 passing below. The pocket is defined in a second drum 112 that carries formed blister packages to its apex for filling. The cup drum 94 and second drum 112 rotate in the direction of arrows B with the timing such that at their tangents one chamber on the cup drum is synchronized with one formed pocket below. A sealing roller 114 applies a film 116 to close the filled packages. Weights can be controlled by adjusting the depth of the pistons at the start of the filling stage.

It can be seen that the present invention maximizes the user's investment in a packaging machine as a whole by allowing the machine to handle aerateable powders with a relatively economical attachment. Thus, the same basic components of the machine can be used regardless of the type of product being packaged. Furthermore, the invention allows the handling of aerateable powders with a very accurate measurement of the pellet weight.

While a preferred form of the invention has been shown and described, it will be realized that alterations and modifications may be made thereto without departing from the scope of the following claims.

We claim:

1. A feeder for supplying a non-aerated pellet of an aerateable powder to a destination, comprising:

a powder supply;

a base member having at least one chamber formed therein, the chamber having first and second ports, the first port being in communication with the powder supply for introducing an aerateable powder into the chamber;

pellet support means associated with the chamber for alternately closing and opening said second port;

a reciprocable piston insertable into the chamber through said first port to compress the aerated powder into a non-aerated pellet while the pellet support means closes said second port and then to eject the pellet through said second port to said destination when the pellet support means opens said second port; and air removal means in fluid communication with the chamber during compression by the piston for removing air from the chamber as the aerated powder is compressed.

2. The feeder of claim 1 wherein the base member comprises a cup plate in a horizontal plane.

3. The feeder of claim 2 wherein the cup plate is rotatably mounted and has a plurality of chambers therein.

4. The feeder of claim 3 wherein the pellet support means comprises a stationary plate having a first portion in sealing relation with the chambers in the cup plate and a second portion having an opening, the chambers being movable over the first and second portions to alternately close and open the chambers.

5. The feeder of claim 1 wherein the piston has a porous metal face attached to a piston rod.

6. The feeder of claim 5 wherein the piston rod has a bore in fluid communication with the metal face of the piston and the air removal means comprises a vacuum source applied to the bore of the piston rod.

7. The feeder of claim 1 wherein the base member is mounted for rotation and the powder supply means includes means for flooding the base member with powder and at least one wiper for directing the powder into the chamber.

8. A method of supplying a non-aerated pellet of an aerateable powder to a destination, comprising the steps of:

defining a chamber in a base member, the chamber having first and second ports;

closing the second port with a pellet support member;

filling the chamber through the first port with an aerateable powder;

inserting a reciprocable piston into the chamber through the first port to compress the aerated powder into a non-aerated pellet while the pellet support member closes the second port;

withdrawing air from the chamber as the piston compresses the powder;

opening the second port by withdrawing the pellet support member; and ejecting the pellet through the second port to said destination by continued insertion of the reciprocable piston into the chamber when the pellet support member opens the second port.

9. In a packaging machine of the type having a rotary filling head for filling a continuous strip of pouches, the filling head including a drum mounted for rotation with a plurality of pouch stations formed on the outer periphery of the drum, the improvement comprising a feeder table for handling aerateable powders, the feeder table comprising:

a cup plate rotatable with the drum in a generally horizontal plane and having an upper surface and a lower surface with a plurality of chambers formed therein and extending through the cup plate from the upper surface to the lower surface, the chambers being aligned with the pouch stations of the filling head drum;

a stationary plate intermediate the cup plate and filling head drum in sealing relation with the cup plate, the stationary plate having an opening therein aligned with the chambers of the rotating cup plate;

a reciprocable piston associated with each chamber and insertable into the chamber to compress the aerated powder into a non-aerated pellet while the chamber is remote from the stationary plate opening and then to eject the pellet through said opening to the pouch stations when the chamber is aligned with the opening; and air removal means in fluid communication with the chamber during compression by the piston for removing air from the chamber as the aerated powder is compressed.

10. The feeder of claim 9 wherein the piston has a porous metal face attached to a piston rod.

11. The feeder of claim 10 wherein the piston rod has a bore in fluid communication with the metal face of the piston and the air removal means comprises a vacuum source applied to the bore of the piston rod.

* * * * *